US011255128B2

(12) United States Patent
Alharbi et al.

(10) Patent No.: US 11,255,128 B2
(45) Date of Patent: Feb. 22, 2022

(54) DRILLING BOREHOLES WITH A HYBRID BIT

(71) Applicant: Saudi Arabian Oil Company, Dhahran (SA)

(72) Inventors: Atallah N. Alharbi, Dhahran (SA); Abdulrahman K. Aleid, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/750,488

(22) Filed: Jan. 23, 2020

(65) Prior Publication Data

US 2021/0230943 A1 Jul. 29, 2021

(51) Int. Cl.

| | |
|---|---|
| ***E21B 10/04*** | (2006.01) |
| ***E21B 10/48*** | (2006.01) |
| ***E21B 10/14*** | (2006.01) |

(52) U.S. Cl.

CPC ..... *E21B 10/04* (2013.01); *E21B 10/14* (2013.01)

(58) Field of Classification Search

CPC ..... E21B 10/02; E21B 10/04; E21B 10/06; E21B 10/48

See application file for complete search history.

(56) References Cited

U.S. PATENT DOCUMENTS

| | | | | |
|---|---|---|---|---|
| 1,836,638 | A * | 12/1931 | Wright | E21B 10/04 175/333 |
| 1,862,814 | A * | 6/1932 | Wright | E21B 10/04 175/397 |
| 3,055,443 | A | 9/1962 | Edwards | |
| 3,610,350 | A * | 10/1971 | Seabourn | E21B 10/02 175/403 |
| 4,640,374 | A | 2/1987 | Dennis | |
| 5,016,718 | A * | 5/1991 | Tandberg | E21B 10/04 175/333 |
| 2006/0196699 | A1 | 9/2006 | Estes et al. | |

FOREIGN PATENT DOCUMENTS

| | | |
|---|---|---|
| CN | 2386178 | 7/2000 |
| CN | 103015899 | 4/2013 |
| EP | 1201873 | 4/2005 |
| GB | 2187774 | 9/1987 |
| WO | WO 2011057303 | 5/2011 |
| WO | 2012039630 | 3/2012 |
| WO | 2013136113 | 9/2013 |
| WO | 2018116140 | 6/2018 |
| WO | WO 2019094011 | 5/2019 |

OTHER PUBLICATIONS

PCT International Search Report and Written Opinion in International Appln. No. PCT/US2021/014317, dated Apr. 13, 2021, 15 pages.

* cited by examiner

*Primary Examiner* — Cathleen R Hutchins
(74) *Attorney, Agent, or Firm* — Fish & Richardson P.C.

(57) ABSTRACT

A hybrid wellbore drilling bit assembly and a method for drilling a borehole with a hybrid wellbore drilling bit assembly are described. A base connects the hybrid wellbore drill bit assembly to a drill string. Blades are connected to the base, extending away from the base along the longitudinal axis and tapering toward the longitudinal axis of the hybrid wellbore drilling bit assembly base creating a tapered cavity. The blades have cutters to shear a core of the Earth that enters the cavity. The core of Earth expands in the cavity. A crusher is connected to the base and positioned within the cavity which crushes the core of Earth.

14 Claims, 8 Drawing Sheets

DRILLING BOREHOLES WITH A HYBRID BIT

TECHNICAL FIELD

This disclosure relates to drilling bits used to form a borehole. More specifically, this disclosure relates to drilling bits forming a borehole by removing Earth for an oil and gas well.

BACKGROUND

Some boreholes are drilled with drilling bits with rolling cones. Drilling bit rolling cones have teeth or inserts for crushing the Earth. Some boreholes are drilled with drilling bits with fixed blades. The drilling bit fixed blades have cutters to shear the Earth. Some boreholes are drilled with drilling bits with cores removed for sampling and testing. Coring drilling bits have cutters or blades arrayed about a cavity to form a core of the Earth. Drilling bits are attached to a drilling assembly controlled by a drilling rig on the surface of the Earth or ocean. Boreholes are drilled to extract natural resources from the Earth. Hydrocarbons are extracted through boreholes for fuel to produce power and for producing plastics and synthetic fabrics.

SUMMARY

This disclosure describes technologies related to drilling a boreholes with a hybrid wellbore drilling bit assembly.

Implementations of the present disclosure include a hybrid wellbore drilling bit assembly and a method for drilling a borehole with a hybrid wellbore drilling bit assembly. A base connects the hybrid wellbore drill bit assembly to a drill string. Blades are connected to the base, extending away from the base along the longitudinal axis and tapering toward the longitudinal axis of the hybrid wellbore drilling bit assembly base creating a tapered cavity. The blades have cutters to shear a core of the Earth that enters the cavity. The core of Earth expands in the cavity. A crusher is connected to the base and positioned within the cavity which crushes the core of Earth.

In some implementations, the hybrid wellbore drilling bit assembly includes blades with a first end connected to the circumference of the base and a second end extending away from the base along the longitudinal axis. The second end of the blades is nearer the longitudinal axis compared to the first end of the blades.

In some implementations, the hybrid wellbore drilling bit assembly further includes a leading ring connected to the second end of the blades. The leading ring drills the Earth and evacuates debris.

In some implementations, the hybrid wellbore drilling bit assembly blades include a first blade and a second blade separated by a gap with a circumferential portion of the leading ring between a first blade and a second blade positioned within the gap and offset from a second end of the first blade and a second end of the second blade.

In some implementations, the hybrid wellbore drilling bit assembly gap and the offset in the leading ring is stepped, sinusoidal, or triangular.

In some implementations, the hybrid wellbore drilling bit assembly crusher further includes a roller to crush the core of the Earth on a second axis extending away from the base.

In some implementations, the surface of the blades, the base, and the crusher define a void. The void evacuates debris from the cavity.

In some implementations, the void is further defined by a leading ring, where the leading ring is connected to the second end of blades. The leading ring drills the Earth and evacuates debris.

Further implementations of the present disclosure include a method for drilling a wellbore with a hybrid wellbore drilling bit assembly that includes a base structurally supporting the wellbore drilling bit assembly to a drill string along a longitudinal axis of the base. The base defines a circumference. The blades have a first end connected to the circumference of the base and a second end extending away from the base along the longitudinal axis and tapering toward the longitudinal axis. The blades shear a core of the Earth. The base and the second end of the blades defining a cavity within which the core of the Earth expands during shearing. A crusher is connected to the base and positioned within the cavity crushing the core of the Earth.

In some implementations, shearing the core of the Earth further includes shearing the core of the Earth with a leading ring connected to the second end of the blades. The leading ring is configured to drill the Earth and to evacuate debris.

In some implementations, shearing the core of the Earth with the leading ring further includes shearing the core of the Earth with a first surface of the leading ring and a second surface of the leading ring, with the second surface of the leading ring offset from the first surface of the leading ring.

In some implementations, the offset between the first surface of the leading ring and the second surface of the leading ring is stepped, sinusoidal, or triangular.

In some implementations, crushing the core of the Earth further includes crushing the core of the Earth with a roller on a second axis extending away from the base.

Further implementations of the present disclosure include a wellbore drilling bit assembly including a base configured to connect the wellbore drill bit assembly to a drill string along a longitudinal axis of the base. The base defines a circumference. The blades connect to the base and extend away from the base along the longitudinal axis and taper toward the longitudinal axis. The blades are arranged on the circumference to define a cavity. The blades are configured to shear a core of the Earth. The cavity is configured to allow the core to expand within the cavity. A crusher is connected to the base and positioned within the cavity. The crusher is configured to crush the core of the Earth. A leading ring is connected to the second ends of the blades, where the blades include a first blade and a second blade separated by a gap and a circumferential portion of the leading ring between a first blade and a second blade positioned within the gap and offset from a second end of the first blade and a second end of the second blade. The leading ring is configured to drill the Earth and to evacuate debris.

In some implementations, the blades each have a first end connected to the circumference of the base and a second end extending away from the base along the longitudinal axis and tapering toward the longitudinal axis that is configured to allow the Earth in the cavity to expand.

In some implementations, the gap and the offset is stepped, sinusoidal, or triangular.

In some implementations, the crusher further includes a roller configured to crush the core of the Earth on a second axis extending away from the base.

In some implementations, a void is defined by a surface of the plurality of the blades, the base, the crusher, and the leading ring. The void is configured to evacuate a debris from the cavity.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes an assembly and a method for drilling a wellbore with a hybrid drilling bit. The hybrid drilling bit combines a fixed blade bit with a coring bit to form a core. Multiple blades shear the Earth forming a core of the Earth. The core of the Earth enters a cavity within the blades. The cavity is tapered longitudinally along the axis of the drilling bit body. The cavity is tapered such that the downhole bottom internal diameter at the entrance of the cavity is smaller than the upper internal diameter of the cavity. The core expands within the cavity as the core travels along the longitudinal axis during drilling. The core reaches the top of the cavity and is crushed by a crusher. The core can be crushed inside the cavity by a fixed crusher or rotating cones. During drilling, the two cutting actions of shearing to form the core and crushing the core occur simultaneously. When the core is crushed, the debris exits the wellbore drilling bit cavity through a junk slot into the well bore annulus.

The present disclosure describes a hybrid wellbore drilling bit that shears the outer portion of wellbore with the blades crushes the remaining inner portion of the wellbore with the crusher.

Implementations of the present disclosure realize one or more of the following advantages. For example, the simultaneous cutting action of shearing to form the core and crushing the core reduces drill string torque. Excessive drill string torque and large torque fluctuations can lead to premature drill string tool failure or drill string twist-off and separation. For example, the simultaneous cutting action of shearing to form the core and crushing the core can increase drilling rate of penetration for a given drill string torque. For example, the simultaneous cutting action of shearing to form the core and crushing the core can reduce the weight on bit required to drill at a given rate of penetration. The weight on bit reduction can decrease drill string buckling and vibration. Excessive drill string vibration and buckling can lead to premature drill string tool failure. Reducing drill string vibration and buckling can improve drill string tool life. For example, crushing the core produces larger debris than shearing. Larger crushed debris can be used for improved formation evaluation when the crushed debris reach the surface. For example, drill string lateral stability is increased during drilling operations. The core formed in the cavity requires higher lateral forces to overcome, increasing lateral drill string stability.

Figure 1:
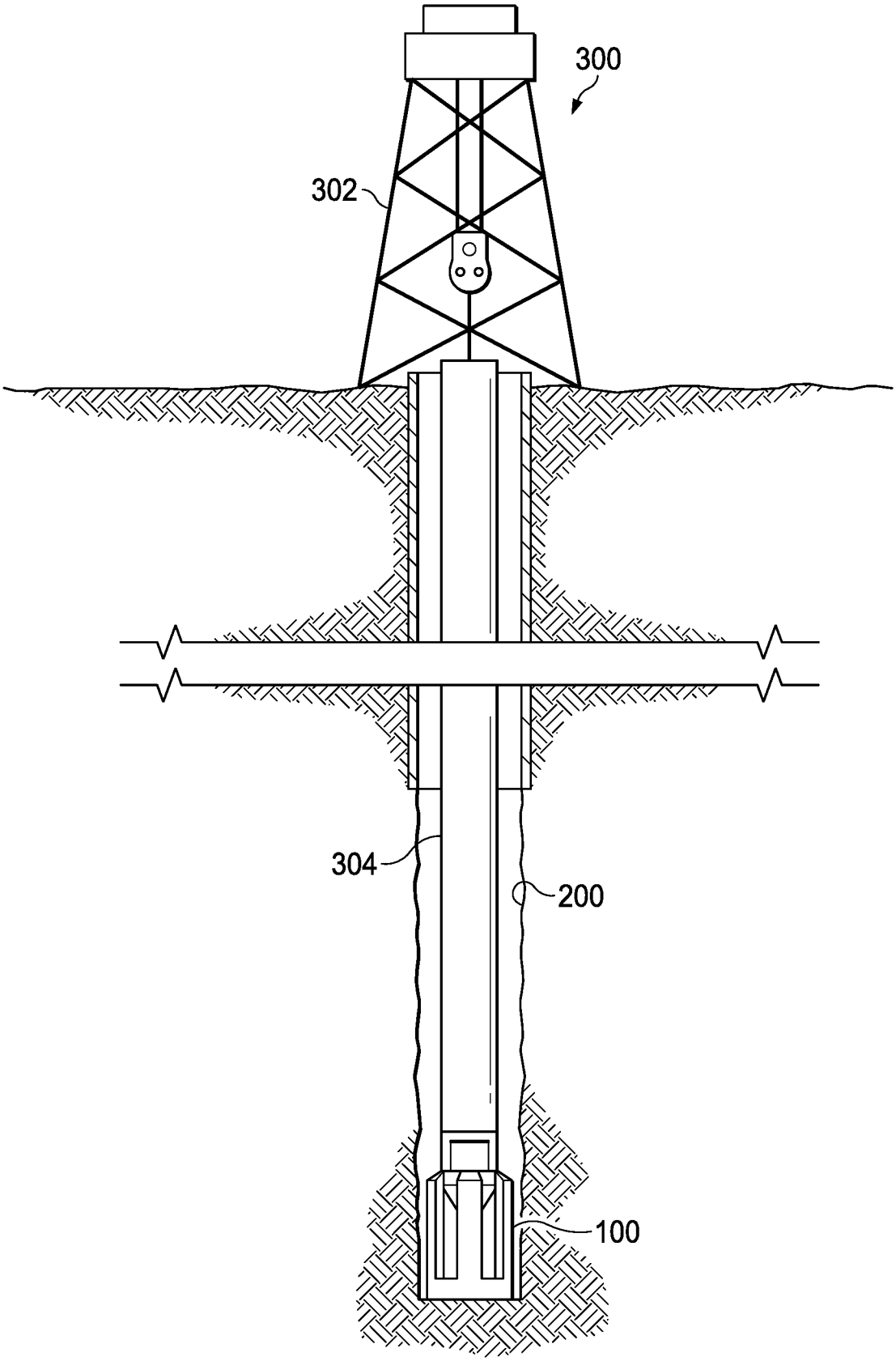
FIG. 1 is a schematic view of a hybrid wellbore drilling bit assembly integrated into a well drilling system.

Referring to FIG. 1, a wellbore drilling bit assembly 100 is used to form a wellbore 200. Wellbore drilling bit assembly 100 is attached to a drilling system 300. The drilling system 300 includes a drilling rig 302 for oil and gas drilling operations. The drilling rig 302 can be a land based or sea-based drilling rig. The drilling rig 302 has a drill string assembly 304 that imparts axial force (weight on bit) and rotational motion (revolutions per minute) to the drilling bit assembly 100, causing the drilling bit assembly 100 to shear and crush a core of the earth. Drill string assembly 304 can include a drilling motor, logging while drilling tools, and measurement while drilling tools. The debris created by the drilling bit assembly 100 travel up the annulus of the borehole 200 to the drilling rig 302.

Figure 2:
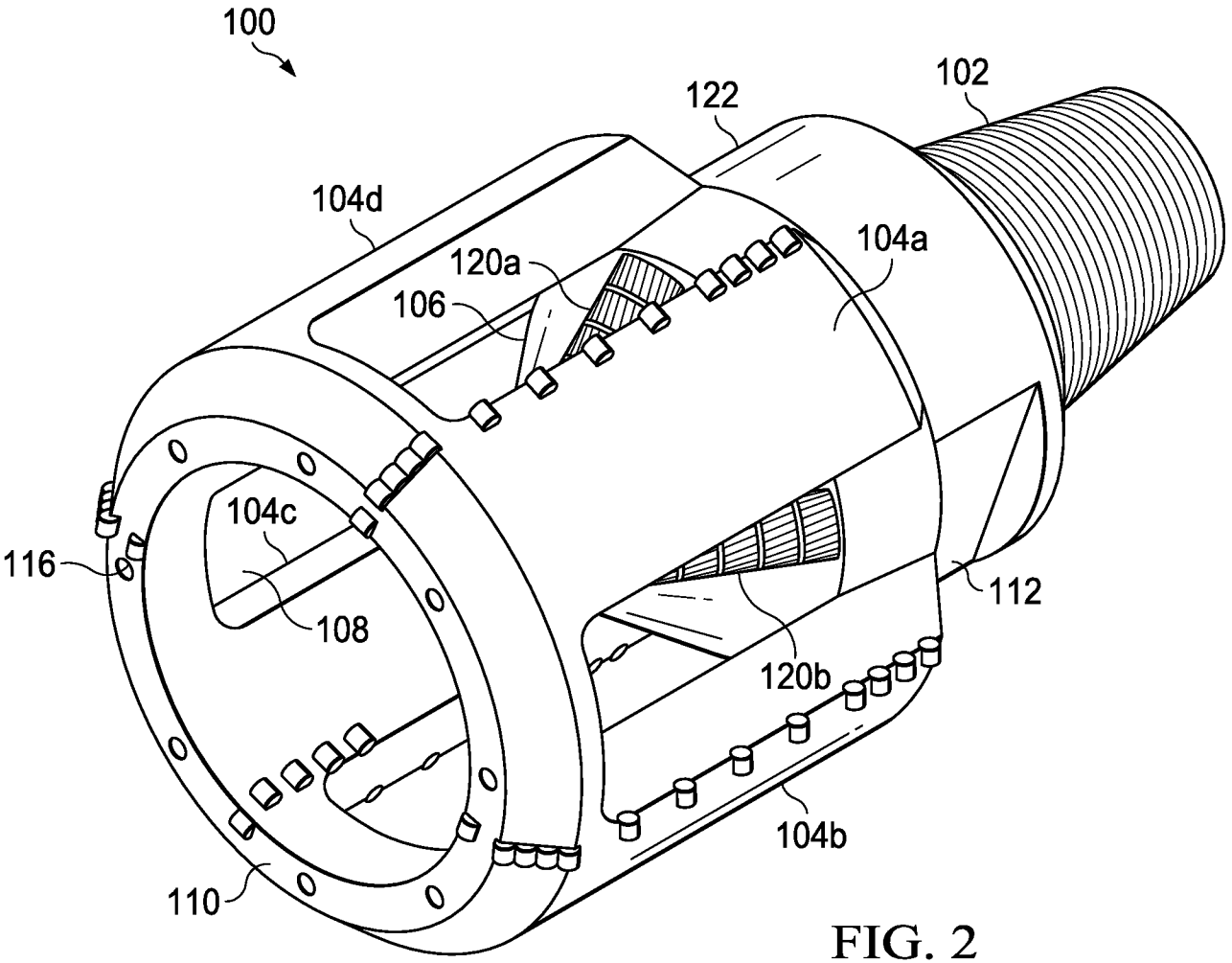
FIG. 2 is a perspective view of a wellbore drilling bit assembly.
Figure 3:
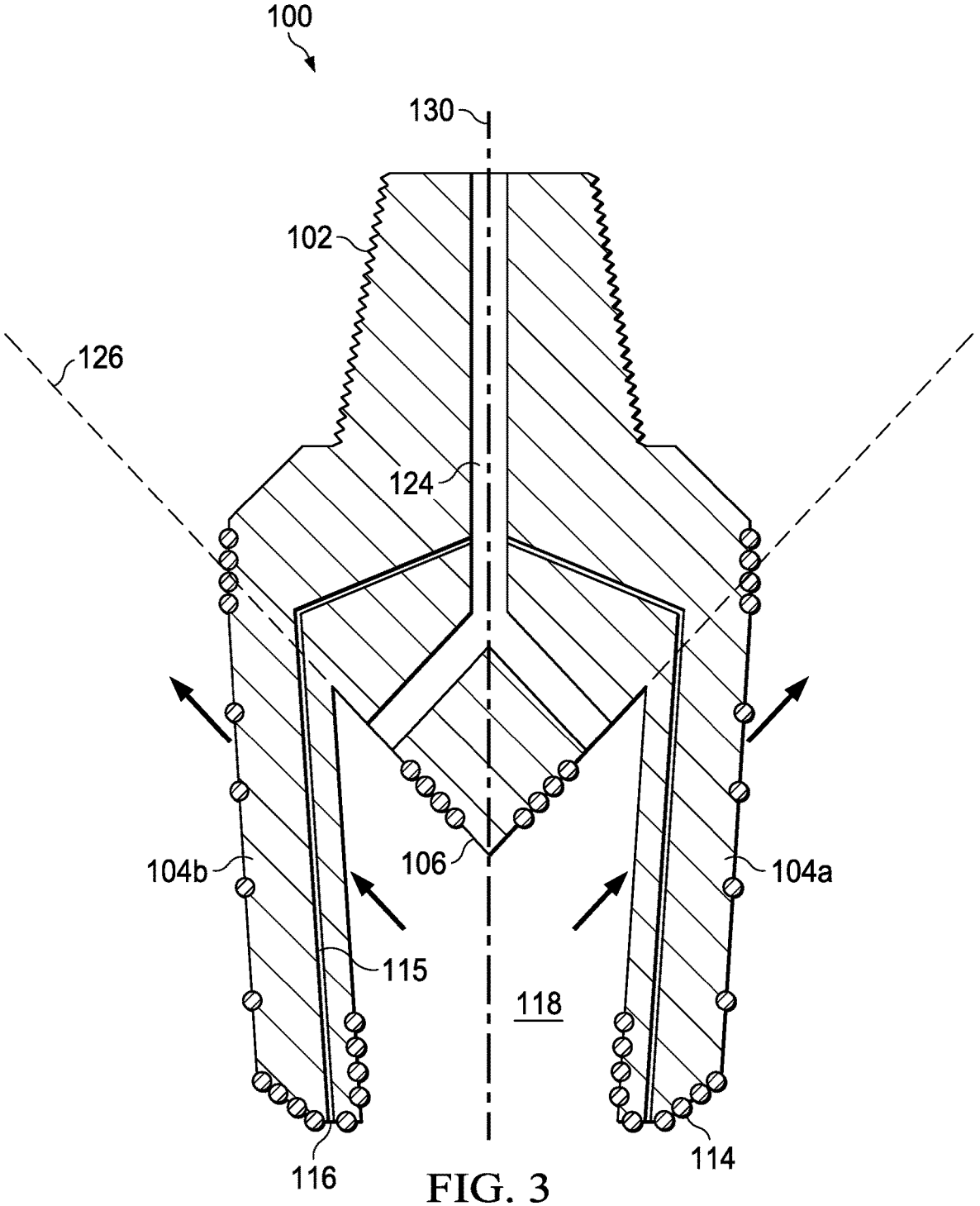
FIG. 3 is a front view of the wellbore drilling bit assembly of FIG. 1.

FIG. 2 shows a perspective view of the wellbore drilling bit assembly 100. FIG. 3 shows a front view of the wellbore drilling bit assembly 100. The drilling bit connector 102 attaches the wellbore drilling bit assembly 100 to the drill string assembly 304. In some implementations, the drilling bit connector 102 is a rotary shouldered connection. In some implementations, the drilling bit connector 102 is a standard API (American Petroleum Institute) pin connection used to attach the wellbore drilling bit assembly 100 to the drill string assembly 304. The standard API rotary shouldered connection is a regular connection, a numeric connection, an internal flush connection, or a full hole connection. In some implementations, the pin connection is manufacturer proprietary design. In some implementations, the drilling bit connector 102 is a box connection, where the threads are internal to the box. The drilling bit connector 102 can have an outer diameter corresponding to a standard American Petroleum Institute connection size. For example, the drilling bit connector 102 can have an outer diameter of 2⅜ inches, 2⅞ inches, 3½ inches, 4½ inches, 5½ inches, 6⅝ inches, 7⅝ inches, or 8⅝ inches.

The drilling bit connector 102 is coupled to the base 122. In some implementations, the drilling bit connector 102 is made of a metal. In some implementations, the drilling bit connector 102 is coupled to the base 122 during the manufacturing process. For example the base 122 can be threaded to the drilling bit connector 102. For example, the drilling bit connector 102 can be welded to the base 122. The base 122 can have an outer diameter corresponding to the standard pin drilling bit connector 122 outer diameter where the base 122 and pin drilling bit connector 102 are welded. In some implementations, the base 122 can have an outer diameter greater than the pin drilling bit connector 102 allowing the pin drilling bit connector 102 to thread to the base 122. In some implementations, the base 122 is made of a metal or metal matrix. For example, the base 122 can be steel. For example, the base 122 can be tungsten carbide matrix.

In some implementations, the base is circular or square shaped. The base 122 is configured to accept a tool used to attach the wellbore drilling bit assembly 100 to the drilling string assembly 304. For example, the base 122 can have a bit breaker slot 112 configured to accept an industry standard bit breaker. The bit breaker is used to attach and remove the wellbore drilling bit assembly 100 from the drill string assembly 304.

The drilling bit assembly has at least one blade 104. In some implementations, multiple blades 104*a-d* are attached to the outer surface of the base 122. For example, blades

104*a*, 104*b*, 104*c*, and 104*d* are attached to the outer surface of the base 122. The drilling bit assembly 100 can have between three and fifteen blades 104, but may have more than fifteen blades 104. In some implementations, the blade 104 is made of a metal or metal matrix. For example, the blade 104 can be steel. For example, the blade 104 can be tungsten carbide matrix. Blade 104 can have a uniform or varying cross section. For example, the blade 104 can have a square, rectangular, or trapezoid shaped cross section. For example, the size or shape of the blade 104 cross section can increase or decrease. In the wellbore drilling bit assembly 100, the blades are coupled to the base 122 to define a cavity 118 as shown in FIG. 3. Blade 104 has a length that spans the length of the cavity 118. The inner diameter of the arrangement of multiple blades 104 defines the inner diameter of the cavity 118. An inner surface of the multiple blades 104 is tapered away from the longitudinal axis 130 creating a cavity 118 of expanding area towards the base 122. The bottom surface 110 of the blades 104 is planar. In some implementations, the bottom surface 110 of the blades 104 may be angled or rounded. The nozzle channel 115 is a void within the blade 104, connected to the fluid channel 124 on one end and the nozzle 116 on the bottom surface 110 of the blade 104 or leading ring 110. The fluid channel 124, nozzle channel 115, and nozzle 116 conduct drilling fluid known as drilling mud or mud through the wellbore drilling bit 100 from the drilling system 300 to the borehole 200 for cooling of cutters 114 and remove of wellbore cutting debris.

The blades 104 shear the Earth by removing a core of Earth that enters into the cavity 118. Removing the core over a length forms the borehole 200. A crusher 106 is attached to the base 122 to crush the core of Earth as the core reaches the crusher 106. The crusher 106 has an outer surface corresponding to an offset axis 126 from the longitudinal axis 130 of the wellbore drilling bit assembly 100. The crusher 106 is configured to crush the core of Earth in the cavity 118 and force the debris toward a junk slot 118. In some implementations, the surface of the crusher 106 is coated with poly-crystalline diamond or tungsten. Each blade 104 has a junk slot 108 to remove debris. The debris created by the shearing of the blades 104 and the crushing of the crusher 106 exit the cavity 118 through a junk slot 108. The debris exit the cavity 118 into the annulus of the borehole 200. The blade 104 and the crusher 106 define a junk slot 108, where an inner void allows transferring drilling mud and debris from the cavity 118.

In some implementations, a leading ring 110 connects the blades 104. The leading ring 110 is configured to shear Earth and evacuate debris. The leading ring 110 defines a bottom plane of the cavity 118. In some implementations, the leading ring 110 is made of a metal or metal matrix. For example, the leading ring 110 can be steel. For example, the leading ring 110 can be tungsten carbide matrix. The leading ring 110 can have dimension corresponding to the blade 114. For example, the leading ring 110 can have a square, rectangular, or trapezoid shaped cross section. For example, the size or shape of the leading ring 110 cross section can increase or decrease. The nozzles 116 conduct drilling fluid out the bottom surface 110 or the angled or rounded surface if the leading ring 110 is a square, rectangular, or trapezoid shaped cross section. In some implementations, the leading ring 110 is optionally coupled to the blades 104. The leading ring 110 can be optionally threaded, bolted, lugged, latched, or pinned to the blades 104. In some implementations, the leading ring 110 is welded to the blades 104. In some implementations, the leading ring 110 is a unitary body with the blades 104.

Multiple cutters 114 are coupled to the blade 104 and the leading ring 110. Cutter 114 can be a poly-crystalline diamond or a tungsten carbide material. In some implementations, multiple cutters 114 are coupled to the crusher 106. Cutters 114 can be circular, domed, pyramid, or coned shaped.

Referring to FIG. 3, fluid channel 124 is fluidically connected to the drilling string assembly 304. Fluid channel 124 is configured to move drilling mud from the drilling string assembly 304 through the drilling bit assembly 100 and out a nozzle 116 on the downhole face of the blade 104 or crusher 106.

Figure 4:
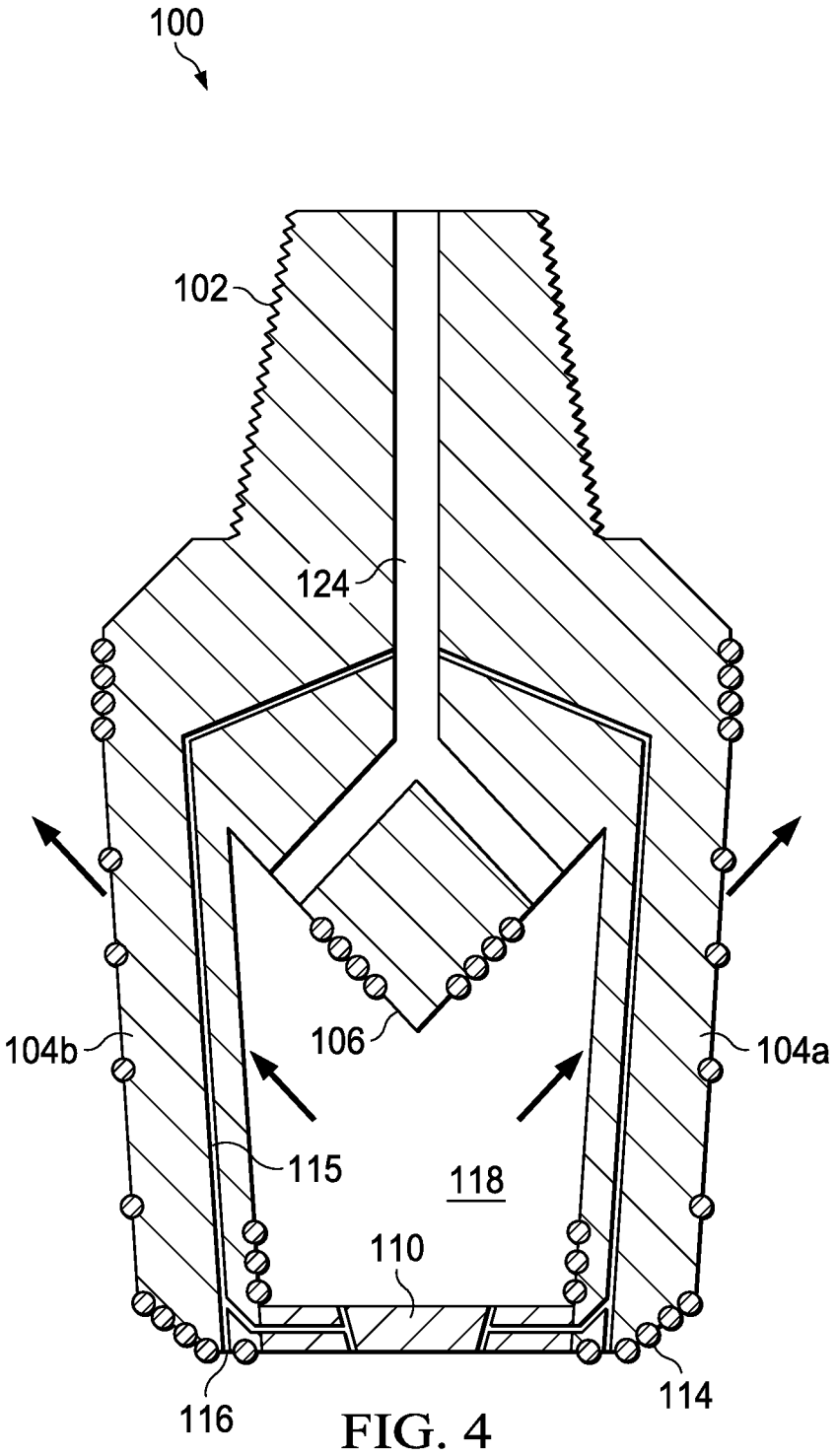
FIG. 4 is a front view of the wellbore drilling bit assembly of FIG. 1, with the leading ring coupled to the blades.

FIG. 4 is a front view of the drilling bit assembly 100 with the leading ring 110. Referring to FIG. 4, the fluid channel 124 is fluidically coupled to nozzles 116 on the leading ring 110. In some implementations, multiple cutters 114 are coupled to the leading ring 110 to shear the Earth.

Figure 5A:
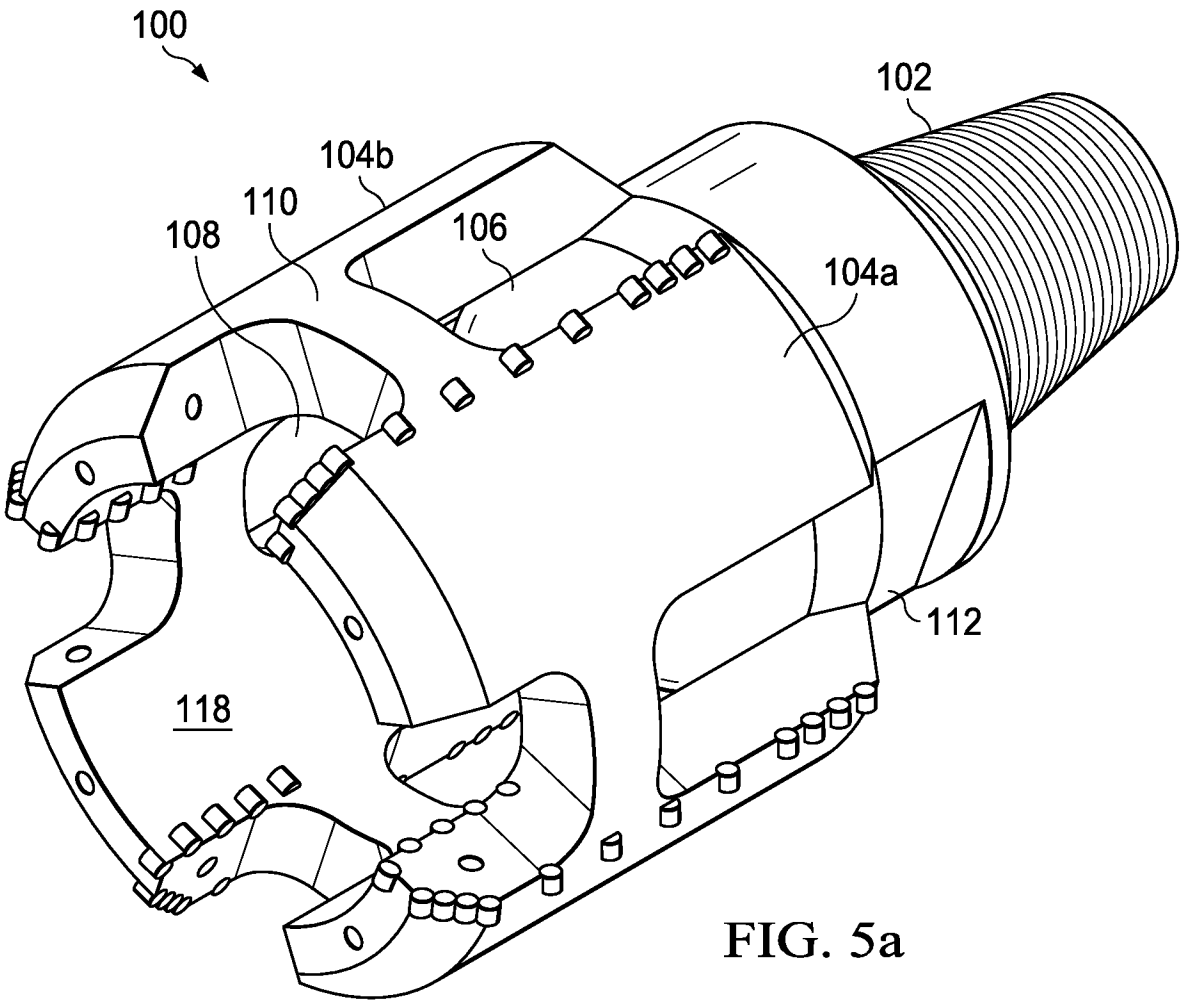
FIG. 5*a* is a perspective view of the wellbore drilling bit assembly of FIG. 1.
Figure 5B:
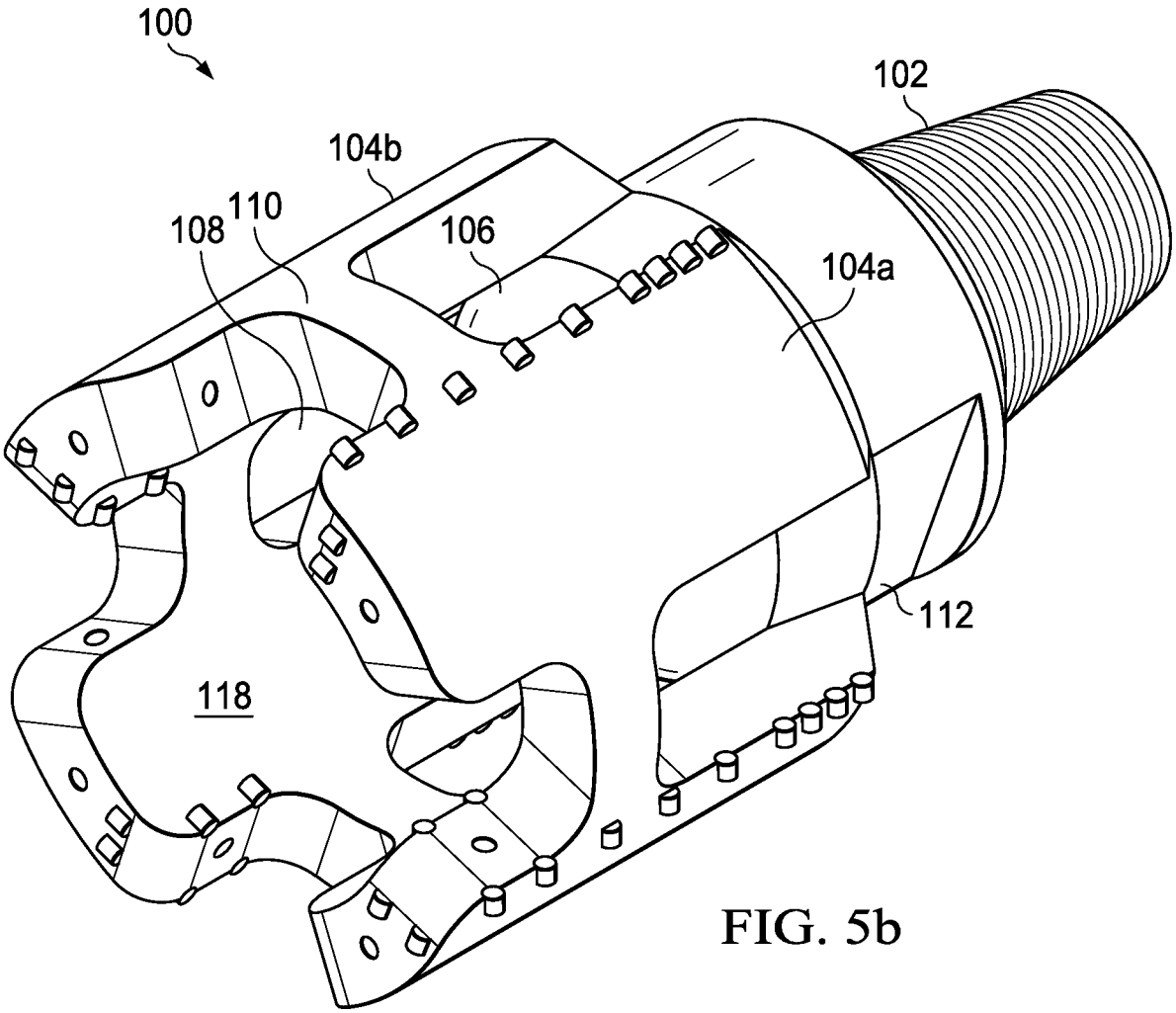
FIG. 5*b* is side view of various leading ring profiles of the wellbore drilling bit assembly of FIG. 1.

FIG. 5*a* and FIG. 5*b* are perspective views of the drilling bit assembly 100 with the leading ring 110. In some implementations, a circumferential portion of the leading ring 110 between a first blade 104*a* and a second blade 104*b* is positioned within the gap and offset from a second end of the first blade 104*a* and a second end of the second blade 104*b*. In some implementations, the leading ring 110 can be straight, stepped, sinusoidal, or triangular. Referring to FIG. 5*a*, the leading ring 110 profile is stepped. Referring to FIG. 5*b*, the leading ring 110 profile is sinusoidal. The leading ring 110 is configured to decrease drill string assembly 304 torque or increasing drill string 304 rate of penetration by reducing cutter 114 or leading ring 110 engagement in the Earth by adjusting the leading ring 110 profile and geometry. The leading ring 110 offset can be nearer to the bottom surface of the leading ring 110, or farther from the bottom surface of the leading ring 110 in increase cutter 114 cooling and debris removal.

Figure 6:
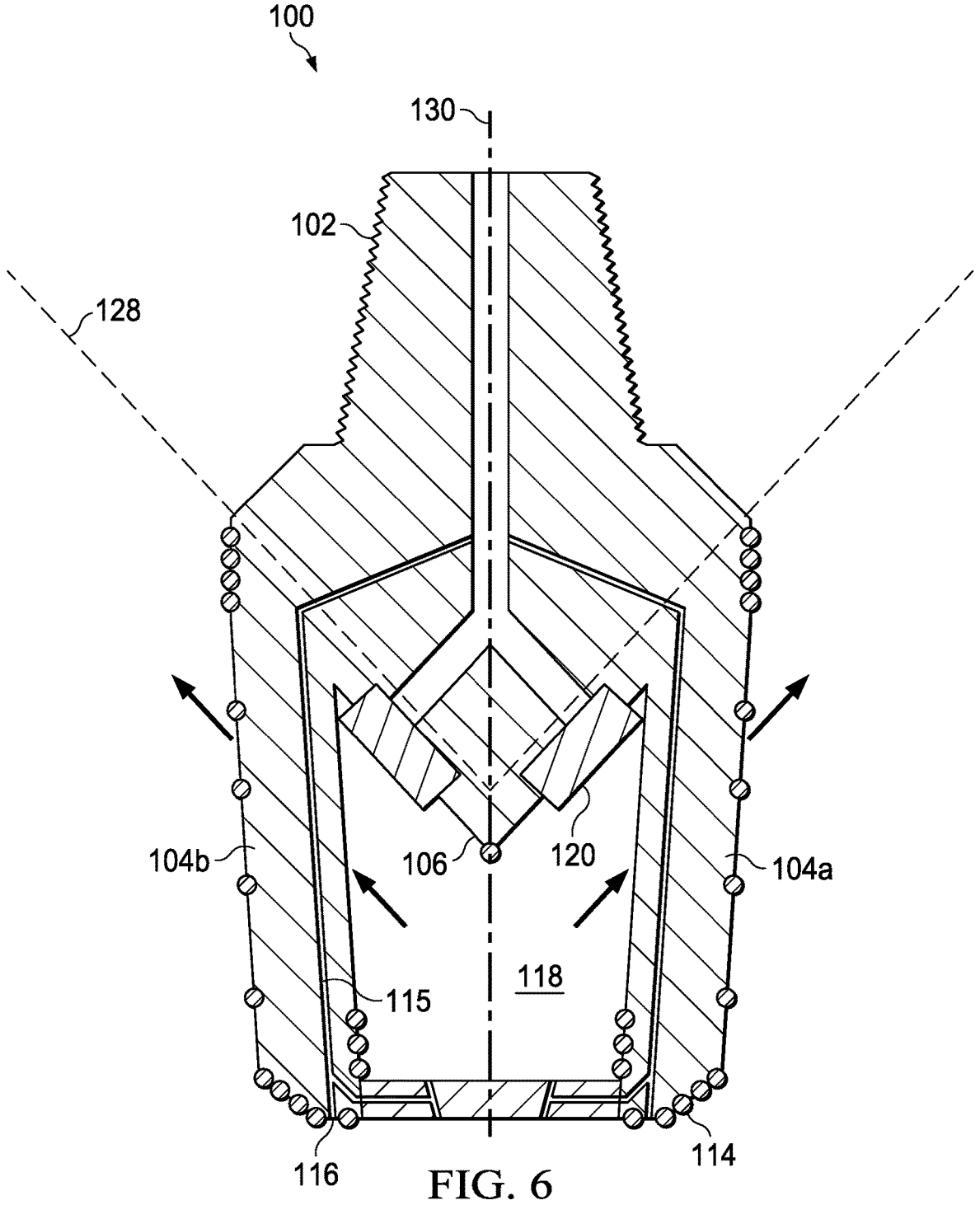
FIG. 6 is a front view of the wellbore drilling bit assembly of FIG. 1, center cone roller coupled to the crusher.

FIG. 6 is a front view of the drilling bit assembly 100 with a roller 120 installed on the crusher 106. The roller 120 is installed on an axis offset by an angle 128 from a longitudinal axis 130 of the drilling bit assembly 100. In some implementations, the roller offset angle 128 corresponds to the crusher surface offset angle 126. The roller 120 can have cutters 114. The roller 120 crushes the core in the cavity 118 and moves the debris to the junk slot 108. The roller 120 can have a flat smooth surface to minimize formation engagement to reduce drilling torque. In some implementations, the roller surface is grooved or toothed to enhance gouging, scraping, grinding, and crushing of the core of the Earth within the cavity 118. The grooved or toothed surface of the roller 120 moves the debris to the junk slot 108.

Figure 7:
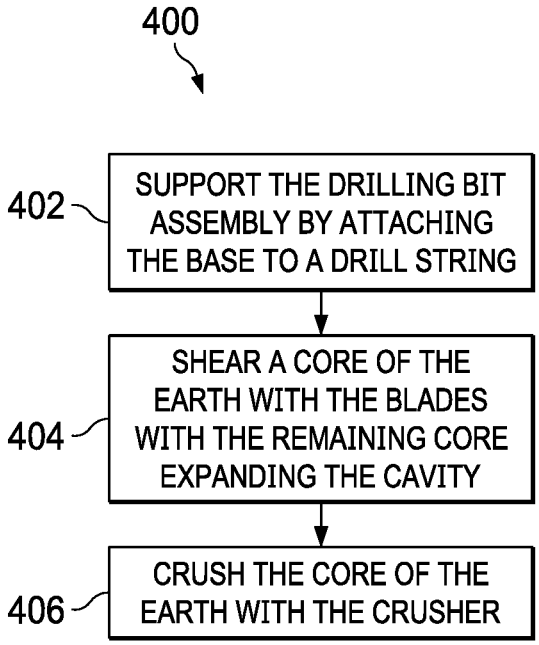
FIG. 7 is a flow chart of an example method of drilling a wellbore with a drilling bit according to implementations of the present disclosure.

FIG. 7 is a flow chart of an example method of drilling a borehole according to the implementations of the present disclosure. This method includes supporting the drill bit assembly by attaching the base to a drill string (402). This method also includes shearing a core of the Earth with the blades with the remaining core expanding the cavity (404). This method also includes crushing the core of Earth with the crusher (406).

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations. For example, the implementations are described with reference to a tee pipe fitting. However, the disclosure can be implemented with any appropriate pipe fitting that connects two or more pipes flowing fluids of different pressures.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, or to about another particular value or a combination of them. When such a range is expressed, it is to be understood that another implementation is from the one particular value or to the other particular value, along with all combinations within said range or a combination of them.

Throughout this application, where patents or publications are referenced, the disclosures of these references in their entireties are intended to be incorporated by reference into this application, in order to more fully describe the state of the art to which the disclosure pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

The invention claimed is:

1. A wellbore drilling bit assembly comprising:

a base configured to connect the wellbore drill bit assembly to a drill string along a longitudinal axis of the base, the base defining a circumference;

a plurality of blades extending away from the base along the longitudinal axis and tapering toward the longitudinal axis, the plurality of blades arranged on the circumference to define a cavity, the plurality of blades configured to shear a core of the Earth, the cavity configured to allow the core to expand within the cavity; and a crusher connected to the base and positioned within the cavity, the crusher configured to crush the core of Earth, the crusher comprising a roller configured to crush the core of the Earth, the roller installed on the crusher, the roller installed on a second axis extending away from the longitudinal axis and toward the circumference.

2. The wellbore drilling bit assembly of claim 1, wherein each blade has a first end connected to the circumference of the base and a second end extending away from the base along the longitudinal axis, the second end nearer the longitudinal axis compared to the first end.

3. The wellbore drilling bit assembly of claim 1, wherein the wellbore drill bit assembly further comprises a leading ring connected to the plurality of the second end of the plurality of blades, the leading ring configured to drill the Earth and to evacuate debris.

4. The wellbore drilling bit assembly of claim 3, wherein the plurality of blades comprise a first blade and a second blade separated by a gap, a circumferential portion of the leading ring between a first blade and a second blade positioned within the gap and offset from a second end of the first blade and a second end of the second blade.

5. The wellbore drilling bit assembly of claim 1, wherein a surface of the plurality of the blades, the base, and the crusher define a void, the void configured to evacuate a debris from the cavity.

6. The wellbore drilling bit assembly of claim 5, wherein the void is further defined by a leading ring, wherein the leading ring is connected to the plurality of the second end of the plurality of blades, the leading ring configured to drill the Earth and to evacuate debris.

7. The wellbore drilling bit assembly of claim 1, wherein an outer surface of the crusher is offset from the longitudinal axis by an angle, wherein the second axis on which the roller is installed is offset by an angle from the longitudinal axis, and wherein the angle by which the crusher is offset from the longitudinal axis corresponds to the angle by which the roller is offset from the longitudinal axis.

8. A method for drilling a wellbore with a wellbore drilling bit assembly comprising:

structurally supporting, by a base of the wellbore drilling bit assembly, the wellbore drilling bit assembly to a drill string along a longitudinal axis of the base, the base defining a circumference;

shearing a core of the Earth, by a plurality of blades, each blade having a first end connected to the circumference of the base and a second end extending away from the base along the longitudinal axis and tapering toward the longitudinal axis, the plurality of blades defining a cavity between the base and the second ends of the plurality of blades within which the core of the Earth expands during shearing; and crushing the core of the Earth, by a crusher connected to the base and positioned within the cavity, wherein the crusher comprises a roller on a second axis extending away from the base, wherein the roller is installed on the crusher, wherein an outer surface of the crusher is offset from the longitudinal axis by an angle, wherein the second axis on which the roller is installed is offset by an angle from the longitudinal axis, and wherein the angle by which the crusher is offset from the longitudinal axis corresponds to the angle by which the roller is offset from the longitudinal axis.

9. The method of claim 8, further comprising shearing the core of the Earth with a leading ring connected to the second end of the plurality of blades, the leading ring configured to drill the Earth and to evacuate debris.

10. The method of claim 9, further comprising:

shearing the core of the Earth with a first surface of the leading ring; and shearing the core of the Earth with a second surface of the leading ring, wherein the second surface of the leading ring is offset from the first surface of the leading ring.

11. A wellbore drilling bit assembly comprising:

a base configured to connect the wellbore drill bit assembly to a drill string along a longitudinal axis of the base, the base defining a circumference;

a plurality of blades extending away from the base along the longitudinal axis and tapering toward the longitudinal axis, the plurality of blades arranged on the circumference to define a cavity, the plurality of blades configured to shear a core of the Earth, the cavity configured to allow the core to expand within the cavity;

a crusher connected to the base and positioned within the cavity, the crusher configured to crush the core of the Earth;

a roller installed on the crusher, wherein an outer surface of the crusher is offset from the longitudinal axis by an angle, wherein the second axis on which the roller is installed is offset by an angle from the longitudinal axis, and wherein the angle by which the crusher is offset from the longitudinal axis corresponds to the angle by which the roller is offset from the longitudinal axis; and a leading ring, the leading ring connected to a plurality of second ends of the plurality of blades, wherein the plurality of blades comprise a first blade and a second blade separated by a gap, a circumferential portion of the leading ring between a first blade and a second blade positioned within the gap and offset from a second end of the first blade and a second end of the second blade, the leading ring configured to drill the Earth and to evacuate debris.

12. The wellbore drilling bit assembly of claim 11, wherein the plurality of blades each blade having a first end connected to the circumference of the base and a second end extending away from the base along the longitudinal axis and tapering toward the longitudinal axis is configured to allow the Earth in the cavity to expand.

13. The wellbore drilling bit assembly of claim 11, wherein the crusher further comprises a roller configured to crush the core of the Earth on a second axis extending away from the longitudinal axis and toward the circumference.

14. The wellbore drilling bit assembly of claim 11, wherein a void defined by a surface of the plurality of the blades, the base, the crusher, and the leading ring, the void configured to evacuate a debris from the cavity.

* * * * *